US008529039B2

(12) United States Patent
Shibata et al.

(10) Patent No.: US 8,529,039 B2
(45) Date of Patent: Sep. 10, 2013

(54) INKJET RECORDING APPARATUS HAVING THICK MANIFOLDS FOR LARGE VOLUME CIRCULATION OF INK

(75) Inventors: Hiroshi Shibata, Kanagawa-ken (JP); Tetsuzo Kadomatsu, Kanagawa-ken (JP); Masaki Kataoka, Ebina (JP); Atsushi Murakami, Ebina (JP)

(73) Assignees: FUJIFILM Corporation, Tokyo (JP); Fuji Xerox Co., Ltd., Tokyo (JP)

( * ) Notice: Subject to any disclaimer, the term of this patent is extended or adjusted under 35 U.S.C. 154(b) by 350 days.

(21) Appl. No.: 12/896,999

(22) Filed: Oct. 4, 2010

(65) Prior Publication Data

US 2011/0080456 A1 Apr. 7, 2011

(30) Foreign Application Priority Data

Oct. 5, 2009 (JP) ..... 2009-231630

(51) Int. Cl.
*B41J 2/18* (2006.01)
*B41J 2/19* (2006.01)
*B41J 2/155* (2006.01)

(52) U.S. Cl.
CPC ... *B41J 2/18* (2013.01); *B41J 2/155* (2013.01); *B41J 2/19* (2013.01)
USPC ..... 347/89; 347/92

(58) Field of Classification Search
USPC ..... 347/89
See application file for complete search history.

(56) References Cited

U.S. PATENT DOCUMENTS 8,038,267 B2 * 10/2011 Kinase et al. ..... 347/85
2002/0196316 A1 * 12/2002 Nakamura ..... 347/84
2008/0055378 A1 * 3/2008 Drury et al. ..... 347/92
2008/0297577 A1 * 12/2008 Wouters et al. ..... 347/89
2009/0102879 A1 * 4/2009 Katada et al. ..... 347/17
2009/0244226 A1 * 10/2009 Hoshino ..... 347/92
2010/0177148 A1 * 7/2010 Asami ..... 347/85
2010/0259575 A1 * 10/2010 Uptergrove ..... 347/14
2011/0074892 A1 * 3/2011 Murakami et al. ..... 347/85
2011/0148997 A1 * 6/2011 Kuribayashi et al. ..... 347/85

FOREIGN PATENT DOCUMENTS

EP 1361066 A1 11/2003
EP 2050572 A2 4/2009
JP 2003-220715 A 8/2003
JP 2006247899 A * 9/2006
JP 2006-281532 A 10/2006
JP 2007-69419 A 3/2007
JP 2009-101516 A 5/2009

OTHER PUBLICATIONS

Japanese Office Action issued Jun. 11, 2013 for related Japanese Patent Application No. 2009-231630 with English translation.

* cited by examiner

*Primary Examiner* — Shelby Fidler
(74) *Attorney, Agent, or Firm* — Birch, Stewart, Kolasch & Birch, LLP

(57) ABSTRACT

The inkjet recording apparatus includes: a supply manifold having an inlet port to which a first main flow channel is connected, the liquid supplied from a tank through the first main flow channel being stored in the supply manifold, the supply manifold being connected to supply ports of head modules; a collection manifold having an outlet port to which a second main flow channel is connected, the liquid to be collected to the tank through the second main flow channel being stored in the collection manifold, the collection manifold being connected to discharge ports of the head modules; and a first bypass flow channel which connects the supply manifold to the collection manifold, wherein an end of the first bypass flow channel is connected to an upper side of an end of the supply manifold on a side opposite to a side where the inlet port is arranged.

9 Claims, 12 Drawing Sheets

INKJET RECORDING APPARATUS HAVING THICK MANIFOLDS FOR LARGE VOLUME CIRCULATION OF INK

BACKGROUND OF THE INVENTION

1. Field of the Invention

The present invention relates to an inkjet recording apparatus, and more particularly to technology for circulating ink in a line head constituted of a plurality of head modules.

2. Description of the Related Art

An inkjet recording apparatus has a recording head (inkjet head) in which a plurality of nozzles are arranged on an ejection face, and records an image on a recording medium by ejecting ink droplets from the nozzles while moving the recording head and the recording medium relatively to each other. The ink ejection method of the recording head includes a piezoelectric method, which ejects an ink droplet from a nozzle by applying pressure to the ink inside a pressure chamber using the displacement of a piezoelectric element, and a thermal method, which ejects an ink droplet from a nozzle by means of the pressure generated when bubbles are produced inside a pressure chamber due to thermal energy produced by a heating element, such as a heater, or the like.

The inkjet recording apparatuses include a serial type and a line type. The serial type apparatus has a recording head in which a nozzle row is arranged in the conveyance direction of the recording medium, and performs recording by intermittently repeating reciprocal movement of the recording head in the width direction of the recording medium (the main scanning direction; the direction perpendicular to the paper conveyance direction) and conveyance of the recording medium. The line type apparatus has a recording head in which a nozzle row is arranged in the width direction of the recording medium, and performs recording by simply moving the recording medium relatively in the paper conveyance direction (the sub-scanning direction) with respect to the recording head. The line type apparatus has a merit in that the recording speed can be raised over that of the serial type apparatus, and is used widely in various industrial fields.

Various technologies have been proposed for the recording heads of the inkjet recording apparatuses; however, in the line type apparatus, it is not practicable to form a single recording head that corresponds to the full width of the recording medium, as a single body, from a silicon wafer, glass, or the like, due to problems relating to the method of manufacture, the production yield, heat generation, cost, and the like. Hence, in the line type apparatus, a long line head having a length corresponding to the full width of the recording medium is formed by aligning a plurality of recording heads (hereinafter referred to as "head modules") which are shorter than the full width of the recording medium, in the width direction of the recording medium, in such a manner that simultaneous recording over the full width of the recording medium can be performed.

In the inkjet recording apparatus, if bubbles are present in ink in flow channels inside the recording heads, then these can give rise to ejection defects, and the like, and hence the ink is circulated between the recording heads and a tank that is open to the air, and the bubbles are thereby collected in the tank and released into the air.

For example, Japanese Patent Application Publication No. 2007-069419 discloses an inkjet recording apparatus in which a line head is constituted of a plurality of head modules, and in order to suppress variation in the ink circulation volume in the respective head modules, ink is supplied from the tank to the head modules and the ink is collected (circulated) from the head modules to the tank, through flow channels including a main flow channel, which is arranged commonly in respect of the plurality of head modules, and a plurality of branch flow channels, which branch from the main flow channel and extend to the respective head modules. However, in Japanese Patent Application Publication No. 2007-069419, the object is to prevent stagnation of bubbles in the branching points between the main flow channel and the branch flow channels, but there is no investigation of the issue of using a manifold having a sufficient thickness in order to achieve a large-volume circulation of ink.

SUMMARY OF THE INVENTION

The present invention has been contrived in view of these circumstances, an object thereof being to provide an inkjet recording apparatus which is able to achieve stable ink circulation in a composition which employs sufficiently thick manifolds to achieve a large-volume circulation of ink to a line head constituted of a plurality of head modules while preventing bubbles from arriving at the head modules.

In order to attain the aforementioned object, the present invention is directed to an inkjet recording apparatus, comprising: a plurality of recording head modules each having supply ports and discharge ports for liquid; a liquid supply manifold which is a liquid chamber having a liquid inlet port to which a first main flow channel is connected, the liquid supplied from a liquid tank through the first main flow channel being stored in the liquid supply manifold, the liquid supply manifold being connected to the supply ports of the recording head modules through first branch flow channels; a liquid collection manifold which is a liquid chamber having a liquid outlet port to which a second main flow channel is connected, the liquid to be collected to the liquid tank through the second main flow channel being stored in the liquid collection manifold, the liquid collection manifold being connected to the discharge ports of the recording head modules through second branch flow channels; a first bypass flow channel which connects the liquid supply manifold to the liquid collection manifold; and a liquid circulation device which circulates the liquid sequentially to the liquid supply manifold, the recording head modules and the liquid collection manifold, wherein: the liquid supply manifold and the liquid collection manifold each have heights in a vertical direction which enable a gas getting mixed with the liquid to separate from the liquid in the vertical direction; and an end of the first bypass flow channel is connected to an upper side in the vertical direction of an end of the liquid supply manifold on a side opposite to a side where the liquid inlet port is arranged.

According to this aspect of the present invention, the liquid supply manifold and the liquid collection manifold each have heights in the vertical direction whereby the gas getting mixed with the liquid can separate from the liquid in the vertical direction, the first bypass flow channel connecting these manifolds together is provided, and one end of the first bypass flow channel is connected to the upper side in the vertical direction (and desirably the upper end face) of the end of the liquid supply manifold on the side opposite to the side where the liquid inlet port is arranged. Hence, bubbles which have entered through the liquid inlet port of the liquid supply manifold collect on the side where the first bypass flow channel is connected and are conveyed by following the flow of the liquid to the liquid collection manifold through the first bypass flow channel, without passing through the recording head modules, and are expelled to the exterior through the liquid outlet port. Furthermore, since the manifolds each have sufficient thicknesses (internal flow channel cross-sectional areas), there is little pressure loss in the manifolds and the pressure difference between the recording head modules can be reduced.

Preferably, the other end of the first bypass flow channel is connected to a lower side in the vertical direction of an end of the liquid collection manifold on a side opposite to a side where the liquid outlet port is arranged.

According to this aspect of the present invention, the bubbles expelled to the liquid collection manifold do not stagnate in the vicinity of the connection between the first bypass flow channel and the liquid collection manifold, and the bubble expulsion characteristics from the liquid supply manifold to the liquid collection manifold are improved.

Preferably, the liquid inlet port is arranged to a lower side in the vertical direction of the liquid supply manifold.

According to this aspect of the present invention, since the liquid inlet port is arranged on the lower side in the vertical direction of the liquid supply manifold where no bubbles are present, it is possible to obtain a stable liquid flow volume which is free of the effects of bubbles.

Preferably, the liquid outlet port is arranged to an upper side in the vertical direction of the liquid collection manifold.

According to this aspect of the present invention, since the liquid outlet port is arranged at a position where the bubbles inside the liquid collection manifold are liable to collect, the bubble expulsion characteristics are improved.

Preferably, the inkjet recording apparatus further comprises: an opening and closing valve which is arranged in the first bypass flow channel; and a valve control device which controls opening and closing operations of the opening and closing valve, wherein the valve control device connects the liquid supply manifold to the liquid collection manifold through the first bypass flow channel by opening the opening and closing valve when performing expulsion of bubbles.

According to this aspect of the present invention, when performing the expulsion of bubbles, the opening and closing valve is opened so as to connect the liquid supply manifold and the liquid collection manifold through the first bypass flow channel, and at other times, the opening and closing valve is closed so as to shut off the connection between the liquid supply manifold and the liquid collection manifold through the first bypass flow channel. Hence, it is possible to suppress variation in the liquid circulation volume due to irregular movement of the bubbles and the liquid.

Preferably, the inkjet recording apparatus further comprises: a second bypass flow channel which connects the liquid supply manifold to the liquid collection manifold, wherein an end of the second bypass flow channel is connected to the lower side in the vertical direction of the end of the liquid supply manifold on the side opposite to the side where the liquid inlet port is arranged, and the other end of the second bypass flow channel is connected to the lower side in the vertical direction of the end of the liquid collection manifold on the side opposite to the side where the liquid outlet port is arranged.

According to this aspect of the present invention, it is possible to reduce the liquid temperature difference between the recording head modules.

Due to the liquid inside the liquid supply manifold flowing to the liquid collection manifold through the second bypass flow channel, the flow speed of the liquid in the vicinity of the end of the liquid supply manifold on the side opposite to the side where the liquid inlet port is arranged is kept at or above a prescribed value, temperature variation due to exchange of heat between the liquid and the surrounding air in the vicinity of the end portion is suppressed and difference in the liquid temperature between the recording head modules can be reduced.

Furthermore, by connecting together the lower sides in the vertical direction of the manifolds (and desirably, the lower end faces thereof) through the second bypass flow channel, it is possible to prevent bubbles from entering into the second bypass flow channel, and a circulation having a stable flow volume can be achieved.

Preferably, a heat insulating member is arranged on an outer circumferential surface of the liquid supply manifold.

According to this aspect of the present invention, by reducing the exchange of heat between the liquid supply manifold and the surrounding air, the temperature difference between a recording head module that is connected to a position close to the liquid inlet port in the liquid supply manifold and a recording head module that is connected to a position distant from the liquid inlet port is reduced, and the temperature difference between the recording head modules can be restricted.

Preferably, a heat insulating member is arranged on an outer circumferential surface of the liquid collection manifold.

According to this aspect of the present invention, by providing a heat insulation member on the outer circumferential surface of the liquid collection manifold, and not just on the liquid supply manifold, it is possible to achieve a more stable state of the liquid circulation, without being affected by the surrounding air.

Preferably, the inkjet recording apparatus further comprises: a first pressure determination device which determines an internal pressure of the liquid supply manifold; and a second pressure determination device which determines an internal pressure of the liquid collection manifold, wherein the liquid circulation device serves as a pressure adjustment device which adjusts the internal pressures of the liquid supply manifold and the liquid collection manifold to prescribed pressures in accordance with determination results obtained by the first and second pressure determination devices.

According to this aspect of the present invention, since the pressure determination devices are arranged in the manifolds, which are the common flow channels closest to the recording head modules, then it is possible to achieve the ink circulation of large volume, with high accuracy (since the liquid flow channel branches, then it is difficult to measure the pressure in the whole of the line head at a position closer to the recording head modules than the manifolds, because of the effects of the head modules).

Preferably, the first pressure determination device is disposed in the end of the liquid supply manifold on the side opposite to the side where the liquid inlet port is arranged; and the second pressure determination device is disposed in the end of the liquid collection manifold on the side opposite to the side where the liquid outlet port is arranged.

According to this aspect of the present invention, since the pressure in the portion of each manifold where the flow speed is slowest is measured, then it is possible to obtain measurement values (pressure values) including little effect of dynamic pressure and even more accurate ink circulation can be achieved.

According to the present invention, the liquid supply manifold and the liquid collection manifold each have heights in the vertical direction whereby the gas getting mixed with the liquid can separate from the liquid in the vertical direction, the first bypass flow channel connecting these manifolds together is provided, and one end of the first bypass flow channel is connected to the upper side in the vertical direction (and desirably the upper end face) of the end of the liquid supply manifold on the side opposite to the side where the liquid inlet port is arranged. Hence, bubbles which have entered through the liquid inlet port of the liquid supply manifold collect on the side where the first bypass flow channel is connected and are conveyed by following the flow of the liquid to the liquid collection manifold through the first bypass flow channel, without passing through the recording head modules, and are expelled to the exterior through the liquid outlet port. Furthermore, since the manifolds each have sufficient thicknesses (internal flow channel cross-sectional areas), there is little pressure loss in the manifolds and the pressure difference between the recording head modules can be reduced.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Configuration of Inkjet Recording Apparatus

Figure 1:
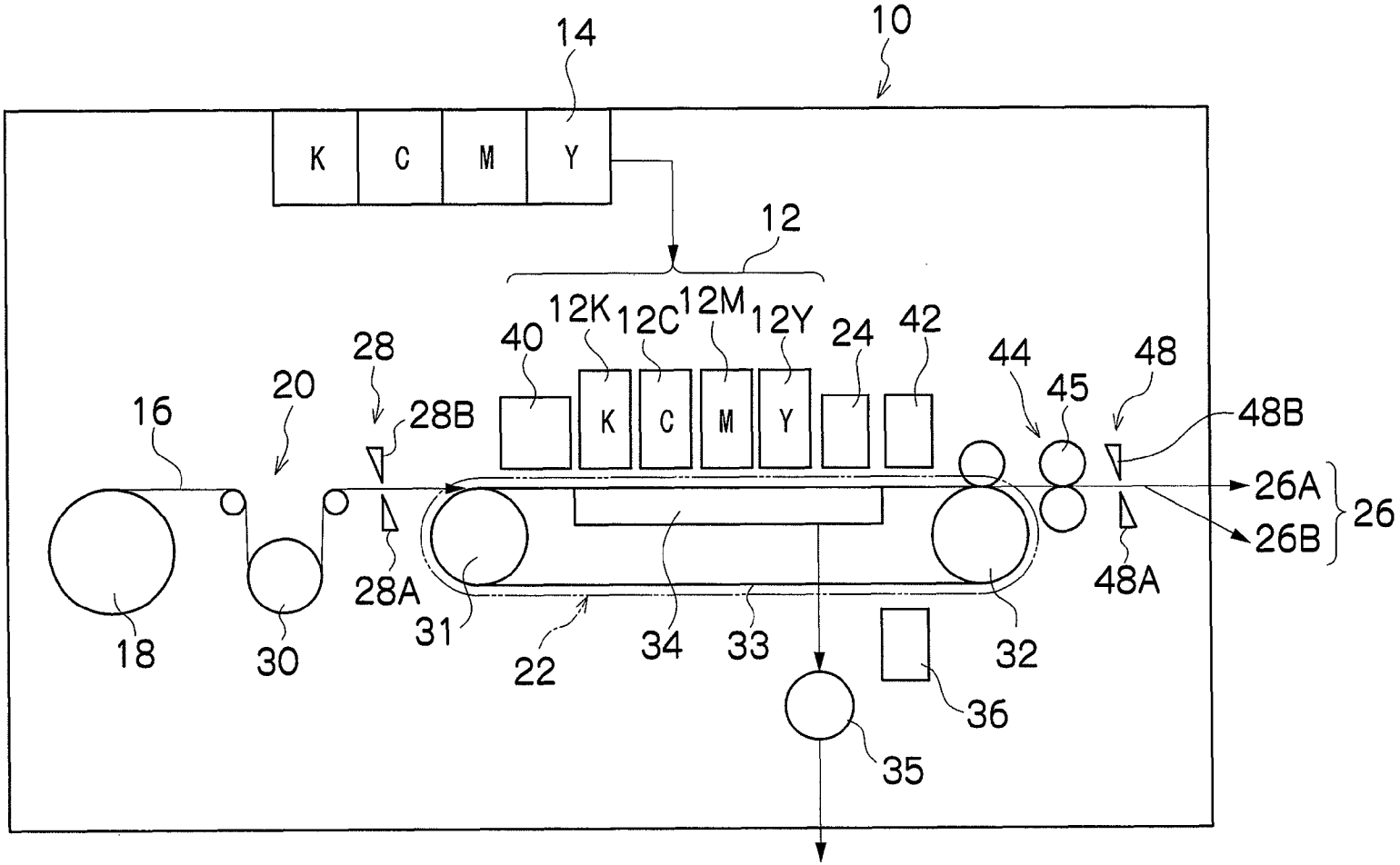
FIG. 1 is a general schematic drawing of an inkjet recording apparatus according to an embodiment of the present invention.

FIG. 1 is a general configuration diagram of an inkjet recording apparatus according to an embodiment of the present invention. As illustrated in FIG. 1, the inkjet recording apparatus 10 includes: a printing unit 12 having a plurality of recording heads (hereafter, also simply called "heads") 12K, 12C, 12M, and 12Y provided for the respective ink colors; an ink storing and loading unit 14 for storing inks of K, C, M and Y to be supplied to the printing heads 12K, 12C, 12M, and 12Y; a paper supply unit 18 for supplying recording paper 16; a decurling unit 20 removing curl in the recording paper 16; a suction belt conveyance unit 22 disposed facing the nozzle face (ink-droplet ejection face) of the printing unit 12, for conveying the recording paper 16 while keeping the recording paper 16 flat; a print determination unit 24 for reading the printed result produced by the printing unit 12; and a paper output unit 26 for outputting image-printed paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of the configuration in which roll paper is used, a cutter 28 is provided as illustrated in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut papers are used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a plane.

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as illustrated in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, and a combination of these. In the case of the configuration in which the belt 33 is nipped with the cleaning rollers, it is preferable to make the line velocity of the cleaning rollers different from that of the belt 33 to improve the cleaning effect.

A roller nip conveyance mechanism, in place of the suction belt conveyance unit 22, can be employed. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
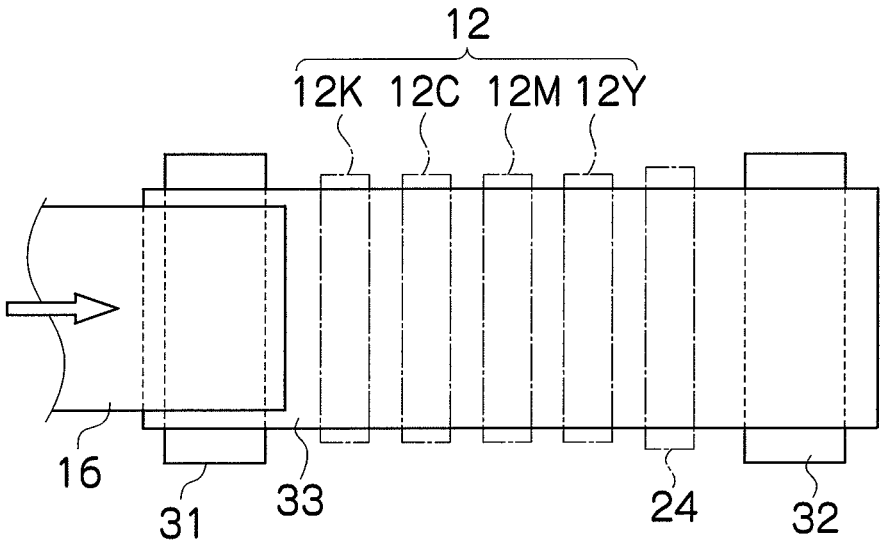
FIG. 2 is a principal plan diagram showing the periphery of a printing unit of the inkjet recording apparatus.

The printing unit 12 is a so-called "full line head" in which a line head having a length corresponding to the maximum paper width is arranged in a direction (main scanning direction) that is perpendicular to the paper conveyance direction (sub scanning direction). Each of the printing heads 12K, 12C, 12M, and 12Y constituting the printing unit 12 is constituted by a line head, in which a plurality of ink ejection ports (nozzles) are arranged along a length that exceeds at least one side of the maximum-size recording paper 16 intended for use in the inkjet recording apparatus 10 (see FIG. 2).

The printing heads 12K, 12C, 12M, and 12Y are arranged in the order of black (K), cyan (C), magenta (M), and yellow (Y) from the upstream side, along the feed direction of the recording paper 16 (hereinafter, referred to as the sub-scanning direction). A color image can be formed on the recording paper 16 by ejecting the inks from the printing heads 12K, 12C, 12M, and 12Y, respectively, onto the recording paper 16 while conveying the recording paper 16.

By adopting the printing unit 12 in which the full line heads covering the full paper width are provided for the respective ink colors in this way, it is possible to record an image on the full surface of the recording paper 16 by performing just one operation of relatively moving the recording paper 16 and the printing unit 12 in the paper conveyance direction (the sub-scanning direction), in other words, by means of a single sub-scanning action. Higher-speed printing is thereby made possible and productivity can be improved in comparison with a shuttle type head configuration in which a head reciprocates in a direction (the main scanning direction) orthogonal to the paper conveyance direction.

Although the configuration with the KCMY four standard colors is described in the present embodiment, combinations of the ink colors and the number of colors are not limited to those. Light inks or dark inks can be added as required. For example, a configuration is possible in which heads for ejecting light-colored inks such as light cyan and light magenta are added.

As illustrated in FIG. 1, the ink storing and loading unit 14 has tanks for storing the inks of K, C, M and Y to be supplied to the heads 12K, 12C, 12M, and 12Y, and the tanks are connected to the heads 12K, 12C, 12M, and 12Y by means of channels, which are omitted from figures. The ink storing and loading unit 14 has a warning device (for example, a display device or an alarm sound generator) for warning when the remaining amount of any ink is low, and has a mechanism for preventing loading errors among the colors.

The print determination unit 24 has an image sensor (line sensor) for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the heads 12K, 12C, 12M, and 12Y for the respective colors, and the ejection of each head is determined. The ejection determination includes measurement of the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

A heating/pressing unit 44 is disposed following the post-drying unit 42. The heating/pressing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not illustrated in FIG. 1, the paper output unit 26A for the target prints is provided with a sorter for collecting prints according to print orders.

Structure of the Head

Next, the structure of heads 12K, 12C, 12M and 12Y is described. The heads 12K, 12C, 12M and 12Y of the respective ink colors have the same structure, and a reference numeral 50 is hereinafter designated to any of the heads.

Figure 3A:
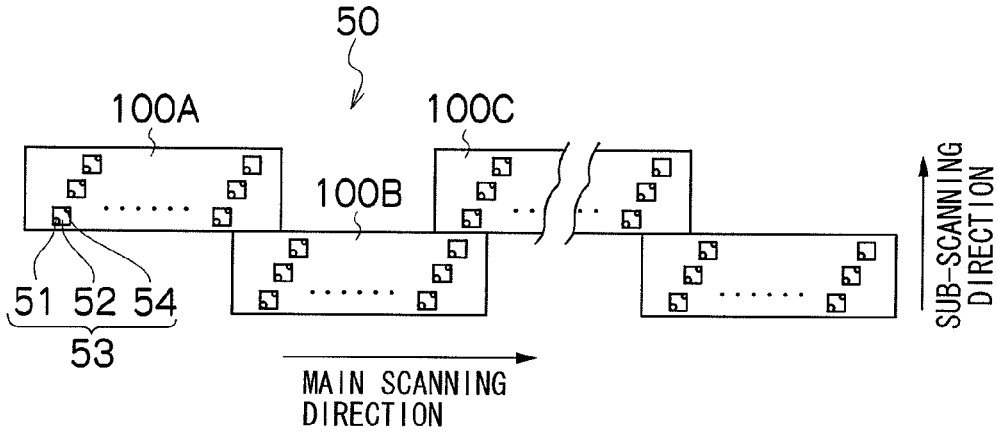
FIGS. 3A and 3B are plan view perspective diagrams showing embodiments of the composition of a printing head.
Figure 3B:
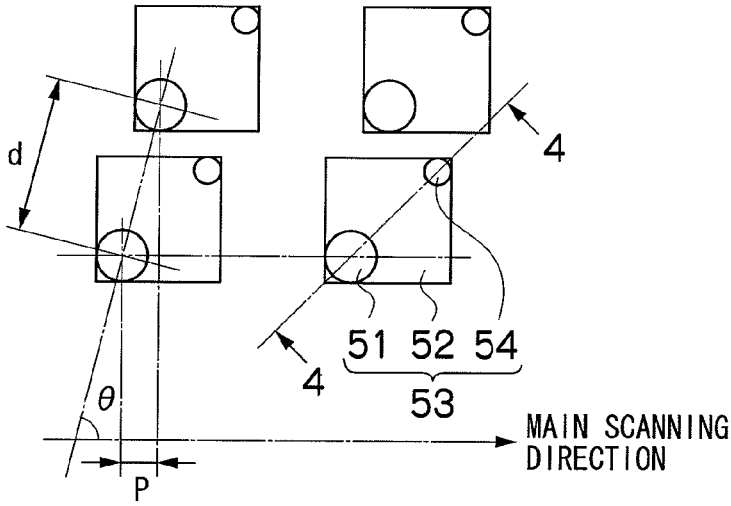
Figure 4:
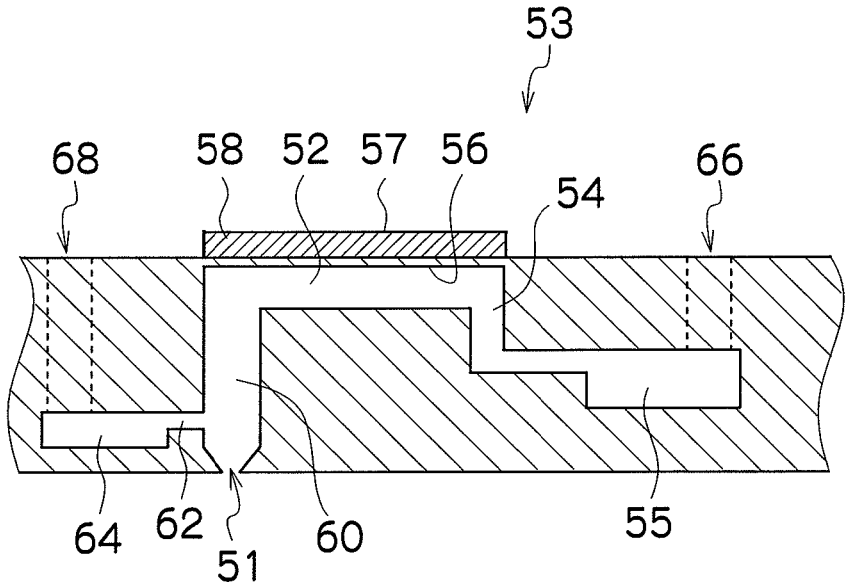
FIG. 4 is a cross-sectional diagram showing the inner composition of an ink chamber unit.

FIG. 3A is a plan view perspective diagram showing an embodiment of the structure of a head 50, and FIG. 3B is a partial enlarged view of same. Furthermore, FIG. 4 is a cross-sectional diagram showing the inner composition of an ink chamber unit (a cross-sectional diagram along line 4-4 in FIG. 3B).

As shown in FIG. 3A, the head 50 according to the present embodiment is a full line type head module having a nozzle row of a length corresponding to the full width of the recording paper 16, and is constituted of a plurality of short head modules 100A, 100B, . . . , which are arranged and joined together in a staggered matrix configuration. In each of the short head modules 100A, 100B, . . . , a plurality of nozzles 51 are arranged two-dimensionally. The structure of the head modules 100A, 100B, . . . , is the same, and a reference numeral 100 is hereinafter designated to any of the head modules, unless specified otherwise.

As illustrated in FIGS. 3A and 3B, each head module 100 has a structure in which a plurality of ink chamber units 53, each having the nozzle 51 forming an ink droplet ejection hole, a pressure chamber 52 corresponding to the nozzle 51, and the like, are disposed two-dimensionally in the form of a staggered matrix, and hence the effective nozzle interval (the projected nozzle pitch) as projected in the lengthwise direction of the head (the main scanning direction perpendicular to the paper conveyance direction) is reduced and high nozzle density is achieved.

In the present embodiment, the full line type head 50 is constituted of the short head modules 100 (100A, 100B, . . . ) arranged and joined together in the staggered matrix configuration; however, the composition of the head 50 is not limited to this and although not shown in the drawings, it is also possible, for example, to compose the head by arranging short head modules in a single row.

The pressure chambers 52 provided corresponding to the respective nozzles 51 are formed with an approximately square planar shape, as shown in FIG. 3B. The nozzle 51 and an ink inlet port 54 are arranged in respective corners on a diagonal of the pressure chamber 52.

As shown in FIG. 4, each of the pressure chambers 52 is connected to a common liquid chamber 55 through the ink inlet port 54. Furthermore, each of the pressure chambers 52 is connected to a nozzle flow channel 60, which is connected to a common circulation flow channel 64 through an independent flow channel 62. Each head module 100 is provided with a supply port 66 and a discharge port 68. The supply port 66 is connected to the common liquid chamber 55, and the discharge port 68 is connected to the common circulation flow channel 64. In other words, the supply port 66 and the discharge port 68 of the head module 100 are connected through the ink flow channels inside the head module (common liquid chamber 55, pressure chambers 52, common circulation flow channel 64, and the like), and as described below, the ink supplied to the supply port 66 from the exterior of the head module is circulated through the ink flow channels inside the head module and discharged through the discharge port 68 to the exterior of the head module.

It is desirable that the individual flow channels 62 are connected to the nozzle flow channels 60 in the vicinity of the nozzles 51 as shown in FIG. 4. Since the ink is thereby allowed to circulate in the vicinity of the nozzles 51, it is then possible to prevent increase in the viscosity of the ink inside the nozzles 51, and to achieve stable ejection.

Piezoelectric elements 58 respectively provided with individual electrodes 57 are bonded to a diaphragm 56 which forms the upper face of the pressure chambers 52 and also serves as a common electrode, and each piezoelectric element 58 is deformed when a drive voltage is supplied to the corresponding individual electrode 57, thereby causing ink to be ejected from the corresponding nozzle 51. When ink is ejected, new ink is supplied to the pressure chambers 52 from the common liquid chamber 55 through the ink inlet ports 54.

In the present embodiment, a piezoelectric element 58 is used as an ink ejection force generating device which causes ink to be ejected from a nozzle 51, but it is also possible to employ a thermal method in which a heater is provided inside the pressure chamber 52 and ink is ejected by using the pressure of the film boiling action caused by the heating action of this heater.

As illustrated in FIG. 3B, the high-density nozzle head according to the present embodiment is achieved by arranging a plurality of ink chamber units 53 having the above-described structure in a lattice fashion based on a fixed arrangement pattern, in a row direction which coincides with the main scanning direction, and a column direction which is inclined at a fixed angle of $\theta$ with respect to the main scanning direction, rather than being perpendicular to the main scanning direction.

More specifically, by adopting a structure in which a plurality of ink chamber units 53 are arranged at a uniform pitch d in line with a direction forming an angle of $\theta$ with respect to the main scanning direction, the pitch P of the nozzles projected so as to align in the main scanning direction is $d \times \cos\theta$, and hence the nozzles 51 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

When implementing the present invention, the arrangement structure of the nozzles is not limited to the example shown in the drawings, and it is also possible to apply various other types of nozzle arrangements, such as an arrangement structure having one nozzle row in the sub-scanning direction.

Configuration of Control System

Figure 5:
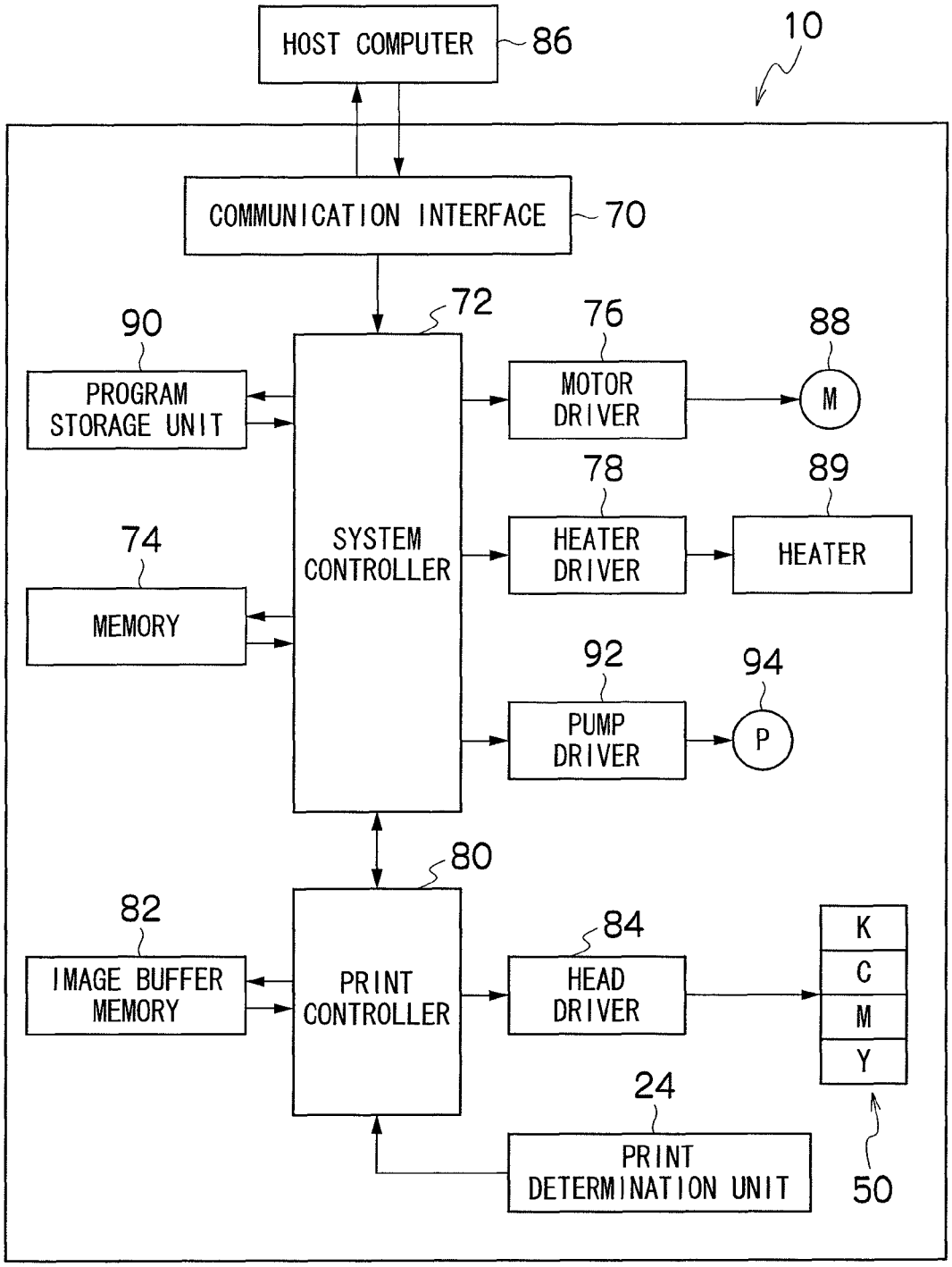
FIG. 5 is a principal block diagram showing the control system of the inkjet recording apparatus.

FIG. 5 is a principal block diagram showing the control system of the inkjet recording apparatus 10. The inkjet recording apparatus 10 comprises a communication interface 70, a system controller 72, a memory 74, a motor driver 76, a heater driver 78, a print controller 80, an image buffer memory 82, a head driver 84, and the like.

The communication interface 70 is an interface unit for receiving image data sent from a host computer 86. A serial interface such as USB (Universal Serial Bus), IEEE1394, Ethernet (registered trademark), wireless network, or a parallel interface such as a Centronics interface may be used as the communication interface 70. A buffer memory (not shown) may be mounted in this portion in order to increase the communication speed.

The image data sent from the host computer 86 is received by the inkjet recording apparatus 10 through the communication interface 70, and is temporarily stored in the memory 74. The memory 74 is a storage device for temporarily storing images inputted through the communication interface 70, and data is written and read to and from the memory 74 through the system controller 72. The memory 74 is not limited to a memory composed of semiconductor elements, and a hard disk drive or another magnetic medium may be used.

The system controller 72 is a control unit which controls the respective sections, such as the communication interface 70, the memory 74, the motor driver 76, the heater driver 78, and the like. The system controller 72 is made up of a central processing unit (CPU) and peripheral circuits thereof, and as well as controlling communications with the host computer 86 and controlling reading from and writing to the memory 74, and the like, and it generates control signals for controlling the motors 88 of the conveyance system and the heaters 89.

Programs executed by the CPU of the system controller 72 and the various types of data which are required for control procedures are stored in the memory 74. The memory 74 is used as a temporary storage region for the image data, and it is also used as a program development region and a calculation work region for the CPU.

Various control programs are stored in the program storage unit 90, and the control programs are read out and executed in accordance with commands from the system controller 72. The program storage unit 90 may use a semiconductor memory, such as a ROM, EEPROM, or a magnetic disk, or the like. An external interface may be provided, and a memory card or PC card may also be used. Naturally, a plurality of these recording media may also be provided. The program storage unit 90 may also be combined with a storage device for storing operational parameters, and the like (not illustrated).

The motor driver (drive circuit) 76 drives the motor 88 in accordance with commands from the system controller 72. The heater driver 78 drives the heater 89 of the post-drying unit 42 and the like in accordance with commands from the system controller 72.

The pump driver 92 is a driver which drives a pump 94 in accordance with the instructions from the system controller 72. The pump 94 shown in FIG. 5 includes pumps 124 and 126 of an ink supply system.

The print controller 80 has a signal processing function for performing various tasks, compensations, and other types of processing for generating print control signals from the image data stored in the memory 74 in accordance with commands from the system controller 72 so as to supply the generated print control signals (dot data) to the head driver 84. Necessary signal processing is carried out in the print controller 80, and the ejection amount and the ejection timing of the ink from the respective recording heads 50 are controlled via the head driver 84, on the basis of the print data. By this means, desired dot size and dot positions can be achieved.

Figure 6:
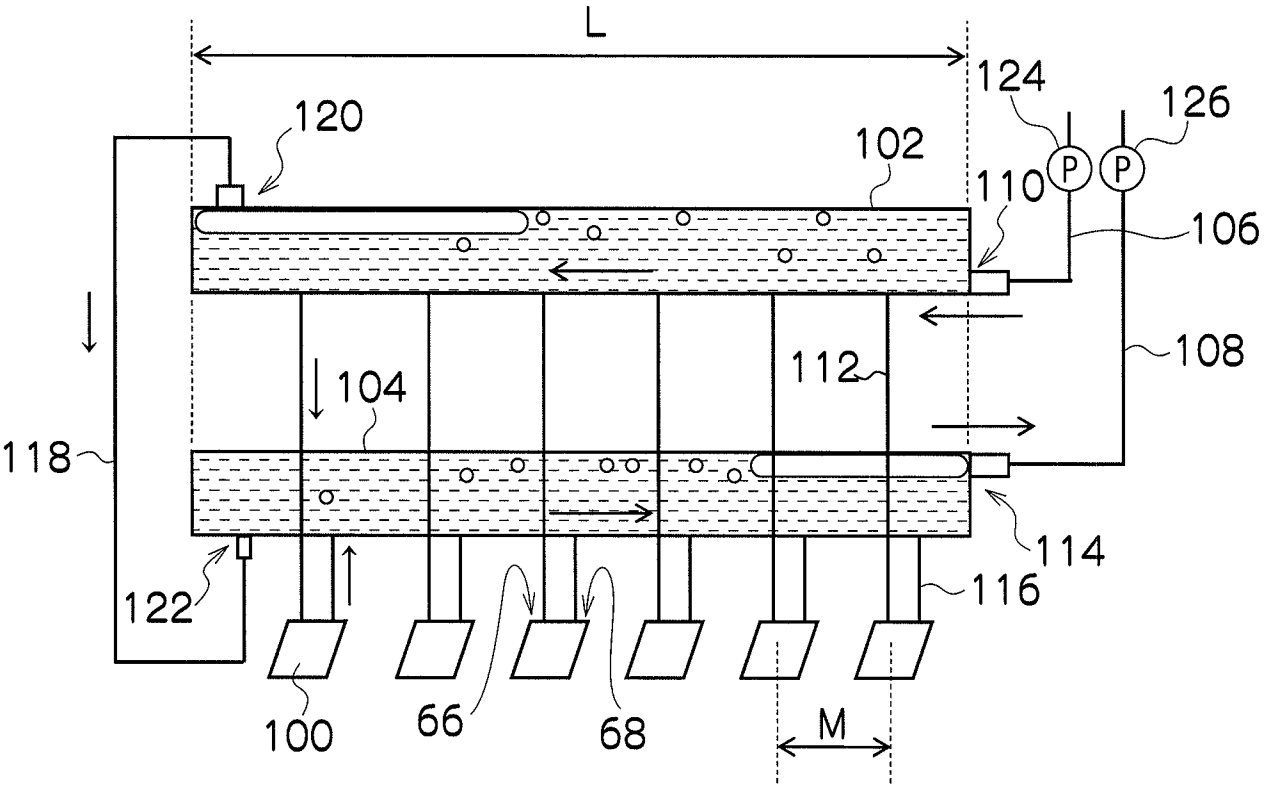
FIG. 6 is a schematic drawing showing the composition of an ink supply system according to a first embodiment.

The print controller 80 is provided with the image buffer memory 82; and image data, parameters, and other data are temporarily stored in the image buffer memory 82 when image data is processed in the print controller 80. The aspect illustrated in FIG. 6 is one in which the image buffer memory 82 accompanies the print controller 80; however, the memory 74 may also serve as the image buffer memory 82. Also possible is an aspect in which the print controller 80 and the system controller 72 are integrated to form a single processor.

The head driver 84 generates drive signals for driving the piezoelectric elements 58 (see FIG. 4) of the recording heads 50 of the respective colors, on the basis of dot data supplied from the print controller 80, and supplies the generated drive signals to the piezoelectric elements 58. A feedback control system for maintaining constant drive conditions in the recording heads 50 may be included in the head driver 84.

The print determination unit 24 is a block that includes the line sensor as described above with reference to FIG. 1, reads the image printed on the recording paper 16, determines the print conditions (presence of the ejection, variation in the dot formation, and the like) by performing prescribed signal processing, and the like, and provides the determination results of the print conditions to the print controller 80.

According to requirements, the print controller 80 makes various corrections with respect to the recording head 50 on the basis of information obtained from the print determination unit 24.

Composition of Ink Supply System

Next, the composition of the ink supply system of the inkjet recording apparatus 10 according to embodiments of the present invention is described.

First Embodiment

FIG. 6 is a schematic drawing showing the composition of the ink supply system according to a first embodiment of the present invention. In FIG. 6, in order to simplify the description, the ink supply system relating to one color only is depicted, and an inkjet recording apparatus of a plurality of colors is provided with a plurality of similar ink supply systems.

As shown in FIG. 6, the ink supply system of the inkjet recording apparatus 10 according to the present embodiment includes an ink supply manifold 102, which is a liquid chamber in which the ink supplied from the ink tank (not shown) to the respective head modules 100 is temporarily stored, and an ink collection manifold 104, which is a liquid chamber in which the ink collected from the head modules 100 to the ink tank is temporarily stored.

Each of the ink supply manifold 102 and the ink collection manifold 104 has a long thin shape having the lengthwise direction thereof along the direction in which the head modules 100 are arranged, and is formed to have a sufficient thickness (internal flow channel cross-sectional area) for a gas and the ink to separate in the vertical direction when the gas gets mixed with the ink.

The ink tank is a base tank (ink supply source) which stores the ink to be supplied to the head modules 100, and corresponds to the tank disposed in the ink storage and loading unit 14 shown in FIG. 1. The ink tank is constituted of an open-air tank, which is connected to the ink supply manifold 102 through a first main flow channel 106 and is connected to the ink collection manifold 104 through a second main flow channel 108. The first main flow channel 106 is provided with a first liquid pump 124, and the second main flow channel 108 is provided with a second liquid pump 126.

An ink inlet port 110 is arranged on a first end of the ink supply manifold 102 in the lengthwise direction thereof (the right-hand end in FIG. 6). The ink inlet port 110 is connected with an end of the first main flow channel 106 (the end on the opposite side to the ink tank). A plurality of first branch flow channels 112 branch off from directly below the ink supply manifold 102, and ends of the first branch flow channels 112 are connected respectively to the supply ports 66 of the head modules 100.

An ink outlet port 114 is arranged on a first end of the ink collection manifold 104 in the lengthwise direction thereof (the right-hand end in FIG. 6). The ink outlet port 114 is connected with an end of the second main flow channel 108 (the end on the opposite side to the ink tank). A plurality of second branch flow channels 116 branch off from directly below the ink collection manifold 104, and ends of the second branch flow channels 116 are connected respectively to the discharge ports 68 of the head modules 100.

According to this composition, when the first liquid pump 124 and the second liquid pump 126 are driven, the ink is supplied to the ink supply manifold 102 from the ink tank through the first main flow channel 106. The supplied ink is distributed to the head modules 100 from the ink supply manifold 102 through the first branch flow channels 112 and the supply ports 66 of the head modules 100. The ink circulated inside the head modules 100 is collected to the ink collection manifold 104 through the discharge ports 68 of the head modules 100 and the second branch flow channels 116.

The collected ink is returned to the ink tank from the ink collection manifold 104 through the second main flow channel 108.

In order to achieve this ink circulation, the system controller 72 shown in FIG. 5 controls the driving of the first liquid pump 124 and the second liquid pump 126 through the drive circuit (pump driver) 92 to adjust the pressures in the ink supply manifold 102 and the ink collection manifold 104 at prescribed pressures.

More specifically, a prescribed pressure differential is set between the ink supply manifold 102 and the ink collection manifold 104 in such a manner that the pressure in the ink supply manifold 102 is relatively higher than the pressure in the ink collection manifold 104, and the driving of the liquid pumps 124 and 126 is controlled in such a manner that a prescribed back pressure (negative pressure) is applied to the ink inside the head modules 100.

To give a more detailed description, the system controller 72 controls the driving of the liquid pumps 124 and 126 so as to satisfy:

$$P_{in}+\Delta P_{h1}>P_{nz1}>P_{out}+\Delta P_{h2} \quad (1)$$

where $P_{in}$ is the pressure in the ink supply manifold 102, $P_{out}$ is the pressure in the ink collection manifold 104, $P_{nz1}$ is the pressure (back pressure) in the head modules 100, $\Delta P_{h1}$ is the pressure differential due to the height differential between the ink supply manifold 102 and the nozzle surfaces of the nozzle modules 100, and $\Delta P_{h2}$ is the pressure differential due to the height differential between the ink collection manifold 104 and the nozzle surfaces of the head modules 100.

By controlling the driving of the liquid pumps 124 and 126 in this way, it is possible to achieve a circulation of the ink inside the head modules 100 (and in particular in the vicinity of the nozzles) at all times, irrespective of whether or not the head modules 100 are performing ejection operation. Thus, it is possible to prevent ejection defects caused by increased viscosity of the ink, or the like, and good print quality can be maintained over a long period of time.

In the ink supply system of the inkjet recording apparatus 10 having the composition described above, in order to improve the expulsion of bubbles which have entered in the ink supply manifold 102, a bubble expulsion bypass flow channel 118 is arranged between the ink supply manifold 102 and the ink collection manifold 104. One end of the bubble expulsion bypass flow channel 118 is connected to a connection port (bubble expulsion port) 120 of the ink supply manifold 102, and the other end of the bubble expulsion bypass flow channel 118 is connected to a connection portion (bubble introduction port) 122 of the ink collection manifold 104.

The connection port 120 of the ink supply manifold 102 is desirably arranged at the upper side in the vertical direction, and desirably on the upper end face, on a second end of the ink supply manifold 102 in the lengthwise direction thereof opposite to the first end where the ink inlet port 110 is arranged. The bubbles which have entered into the ink supply manifold 102 from the ink inlet port 110 are liable to follow the flow of the ink, in a separated state from the ink, and accumulate at the upper side in the vertical direction on the second end of the ink supply manifold 102, which is opposite to the side where the ink inlet port 110 is arranged. Hence, the connection port 120 is arranged in the ink supply manifold 102 at the upper side in the vertical direction on the second end in the lengthwise direction thereof, and bubbles which have entered in the ink supply manifold 102 do not stagnate and can be conveyed easily and reliably through the bubble expulsion bypass flow channel 118 to the ink collection manifold 104.

The connection port 122 of the ink collection manifold 104 is desirably arranged at the lower side in the vertical direction, and desirably on the lower end face, on a second end of the ink collection manifold 104 in the lengthwise direction thereof opposite to the first end where the ink outlet port 114 is arranged. If the connection port 122 is arranged at the upper side in the vertical direction of the ink collection manifold 104, there is a concern that conveyance of bubbles from the ink supply manifold 102 to the ink collection manifold 104 will become difficult due to the effects of bubbles having accumulated inside the ink collection manifold 104. Hence, the connection port 122 is arranged in the ink collection manifold 104 at the lower side in the vertical direction on the second end in the lengthwise direction thereof, and it is possible to convey the bubbles easily and reliably from the ink supply manifold 102 to the ink collection manifold 104, without being affected by bubbles which are present inside the ink collection manifold 104. The bubbles conveyed to the ink collection manifold 104 follow the flow of the ink and collect in the first end in the lengthwise direction on the opposite side thereof (the right-hand side in FIG. 6), and are expelled from the ink outlet port 114 arranged at this position through the second main flow channel 108 to the ink tank and released into the atmosphere.

The ink outlet port 114 of the ink collection manifold 104 is desirably arranged at the upper side in the vertical direction, and desirably in the vicinity of the uppermost portion, on the first end in the lengthwise direction of the ink collection manifold 104 (the right-hand side in FIG. 6). The bubbles collected in the ink collection manifold 104 are liable to accumulate on the upper side in the vertical direction thereof. If the ink outlet port 114 is arranged on the lower side in the vertical direction of the ink collection manifold 104, the bubbles cannot be released into the atmosphere from the ink tank through the second main flow channel 108. Hence, the ink outlet port 114 is arranged on the upper side in the vertical direction of the ink collection manifold 104, and it is possible to release the bubbles inside the ink collection manifold 104 through the second main flow channel 108 and the ink tank into the atmosphere.

The ink inlet port 110 of the ink supply manifold 102 is desirably arranged at the lower side in the vertical direction, and desirably in the vicinity of the lowermost portion, on the first end in the lengthwise direction of the ink supply manifold 102 (the right-hand side in FIG. 6). If the ink inlet port 110 is arranged on the upper side in the vertical direction of the ink supply manifold 102, variation occurs in the flow channel resistance due to the effects of bubbles having entered in the ink supply manifold 102, and it may become impossible to achieve a stable ink flow volume. Hence, the ink inlet port 110 is arranged in the ink supply manifold 102 at the lower side in the vertical direction on the first end in the lengthwise direction thereof, and it is possible to obtain a stable ink flow volume without being affected by the bubbles.

In the present embodiment, each of the ink supply manifold 102 and the ink collection manifold 104 is formed to have the same thickness in the lengthwise direction of the manifold; however, the present invention is not limited to this, and it is also possible to form the manifolds in such a manner that, for example, the thickness changes gradually from one end toward the other end in the lengthwise direction as in the sixth embodiment described below (see FIG. 11), or in such a manner that the thickness of the central portion is different from that of either end in the lengthwise direction. Here, it is necessary to take account of the bubble expulsion characteristics when deciding the positions at which the ink inlet port 110, the ink outlet port 114 and the connection ports 120 and 122 are to be arranged.

In the present embodiment, the ink supply manifold 102 and the ink collection manifold 104 have a length equal to or greater than the line head 50 (shown in FIG. 3A, not shown in FIG. 6) constituted of the head modules 100, and are arranged substantially parallel with the direction in which the head modules 100 are arranged (the main scanning direction). Thus, the flow channel lengths of the branch flow channels from the ink supply manifold 102 and the ink collection manifold 104 to the respective head modules 100 are uniform between the head modules, the pressure losses in the head modules 100 are made uniform, and the ink can be stably circulated to the head modules 100.

In the present embodiment, as shown in FIG. 6, the head modules 100, the ink collection manifold 104 and the ink supply manifold 102 are arranged in order from the lower side to the upper side in the vertical direction; however, the order in which these elements are arranged is not limited in particular, provided that a prescribed pressure differential is set between the ink supply manifold 102 and the ink collection manifold 104, in such a manner that circulation of the ink can be achieved.

In the present embodiment, each of the ink supply manifold 102 and the ink collection manifold 104 has a sufficient thickness (internal flow channel cross-sectional area) for gas and the ink to separate in the vertical direction even if the gas has gotten mixed with the ink, and hence there is little pressure loss inside the manifolds 102 and 104, and it is possible to reduce the pressure differential between the head modules 100. Moreover, even if a gas enters into the ink supply manifold 102 and the ink collection manifold 104, since this gas stagnates on the upper sides in the vertical direction, then it never reaches the head modules 100 through the branch flow channels 112 and 116, which are arranged on the lower sides in the vertical direction.

Second Embodiment

Figure 7:
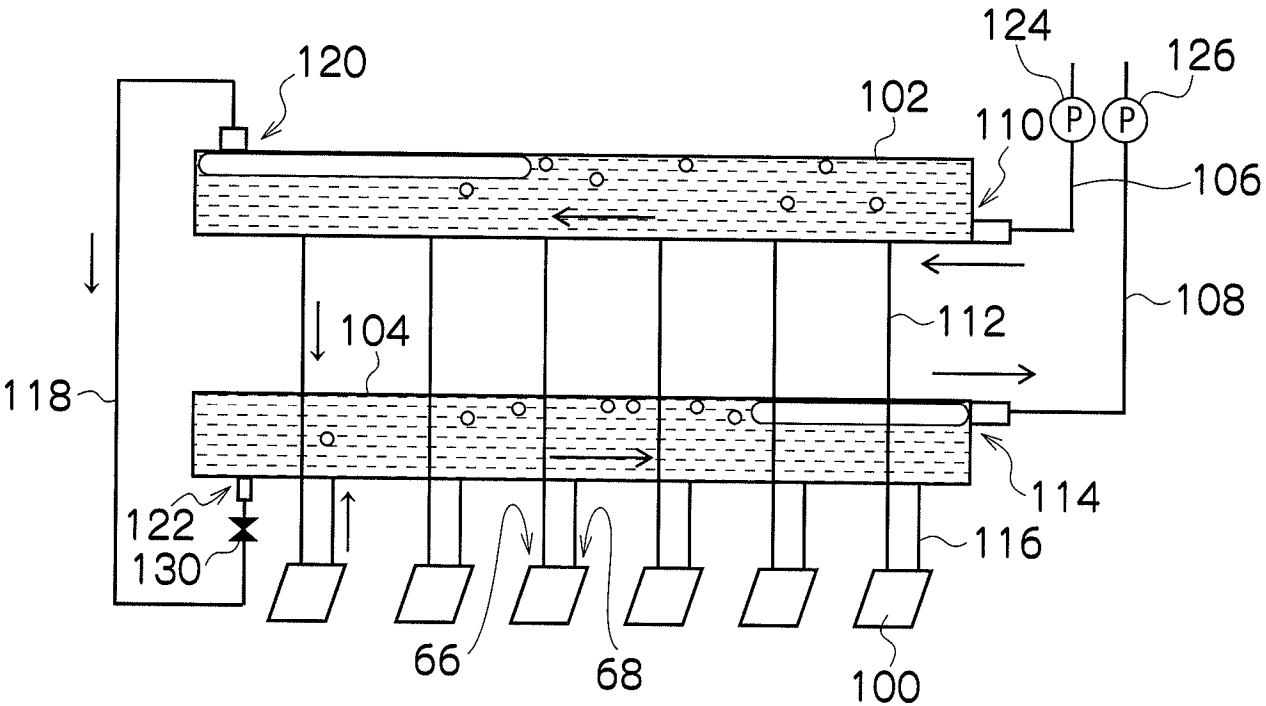
FIG. 7 is a schematic drawing showing the composition of an ink supply system according to a second embodiment.

FIG. 7 is a schematic drawing showing the composition of the ink supply system according to a second embodiment of the present invention. In FIG. 7, elements which are the same as or similar to those in FIG. 6 are denoted with the same reference numerals and description thereof is omitted here.

In the second embodiment, the bubble expulsion bypass flow channel 118 is provided with a valve (opening/closing valve) 130 as shown in FIG. 7. The opening and closing operation of the valve 130 is controlled by the system controller 72 shown in FIG. 5.

When performing the expulsion of bubbles, the system controller 72 implements control to open the valve 130, set the ink supply manifold 102 and the ink collection manifold 104 to a connected state through the bubble expulsion bypass flow channel 118, and move the bubbles in the ink supply manifold 102 to the ink collection manifold 104 through the bubble expulsion bypass flow channel 118. On the other hand, at other times (when not performing the expulsion of bubbles), the system controller 72 implements control to close the valve 130, and set the ink supply manifold 102 and the ink collection manifold 104 to a non-connected state through the bubble expulsion bypass flow channel 118.

According to the second embodiment, it is possible to suppress variation in the ink circulation flow volume caused by irregular movement of bubbles.

Third Embodiment

Figure 8:
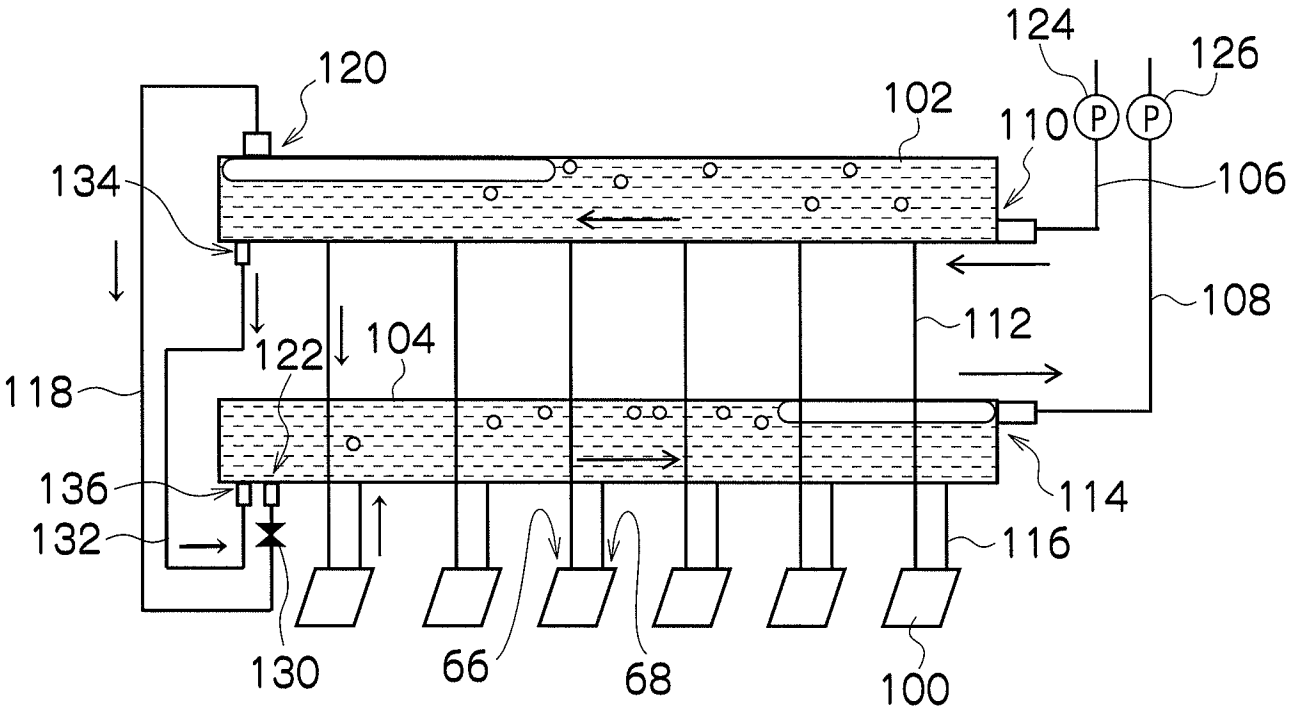
FIG. 8 is a schematic drawing showing the composition of an ink supply system according to a third embodiment.

FIG. 8 is a schematic drawing showing the composition of the ink supply system according to a third embodiment of the present invention. In FIG. 8, elements which are the same as or similar to those in FIG. 6 or 7 are denoted with the same reference numerals and description thereof is omitted here.

If the ink supply manifold 102 and the ink collection manifold 104 are composed to have thick dimensions as in the respective embodiments described above, the ink flow rate in the manifolds becomes slow, the ink temperature varies due to exchange of heat with the surrounding air, and there is a concern that a difference will occur in the ink temperature between the head modules 100.

Hence, in the third embodiment, a circulation bypass flow channel 132, which is separate from the bubble expulsion bypass flow channel 118, is arranged between the ink supply manifold 102 and the ink collection manifold 104 as shown in FIG. 8. Thus, it is possible to circulate the ink directly from the ink supply manifold 102 to the ink collection manifold 104, without passing through the head modules 100.

A connection port (ink discharge port) 134 to which an end of the circulation bypass flow channel 132 is connected is desirably arranged in the ink supply manifold 102 at the lower side in the vertical direction (desirably, on the lower end face) on the second end in the lengthwise direction thereof (the end on the side opposite to the ink inlet port 110; the left-hand end in FIG. 8).

A connection port (ink inlet port) 136 to which the other end of the circulation bypass flow channel 132 is connected is desirably arranged in the ink collection manifold 104 at the lower side in the vertical direction (desirably, on the lower end face) on the second end in the lengthwise direction thereof (the end on the side opposite to the ink outlet port 114; the left-hand end in FIG. 8).

According to the third embodiment, by carrying out ink circulation though the circulation bypass flow channel 132 during the printing operation, it is possible to reduce the difference in the ink temperature between the head modules 100.

Moreover, since the circulation bypass flow channel 132 is connected to the lower sides in the vertical direction (and desirably on the lower end faces) of the ink supply manifold 102 and the ink collection manifold 104, entering of bubbles into the circulation bypass flow channel 132 is prevented and circulation of a stable flow volume can be achieved.

Fourth Embodiment

Figure 9:
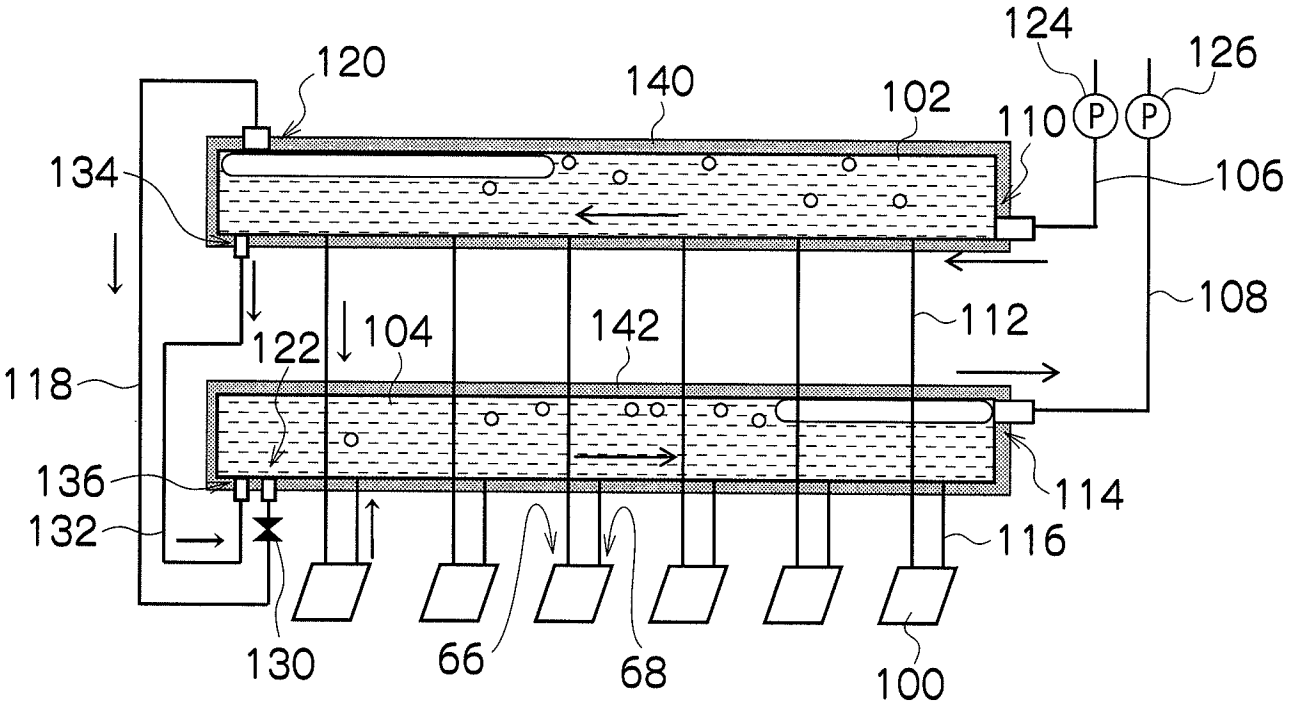
FIG. 9 is a schematic drawing showing the composition of an ink supply system according to a fourth embodiment.

FIG. 9 is a schematic drawing showing the composition of the ink supply system according to a fourth embodiment of the present invention. In FIG. 9, elements which are the same as or similar to those in FIGS. 6 to 8 are denoted with the same reference numerals and description thereof is omitted here.

In the fourth embodiment, heat insulating members 140 and 142 are arranged on the outer circumferential surfaces of the ink supply manifold 102 and the ink collection manifold 104 as shown in FIG. 9.

According to the fourth embodiment, it is possible to reduce the exchange of heat between the ink supply manifold 102 and the surrounding air by means of the heat insulating member 140 arranged on the outer circumferential surface of the ink supply manifold 102, and temperature difference between the head modules 100 can be further reduced.

Moreover, it is also possible to achieve ink circulation in a more stable state, without being affected by the surrounding air, by arranging the heat insulating member 142 also on the outer circumferential surface of the ink collection manifold 104 in addition to the ink supply manifold 102.

Fifth Embodiment

Figure 10:
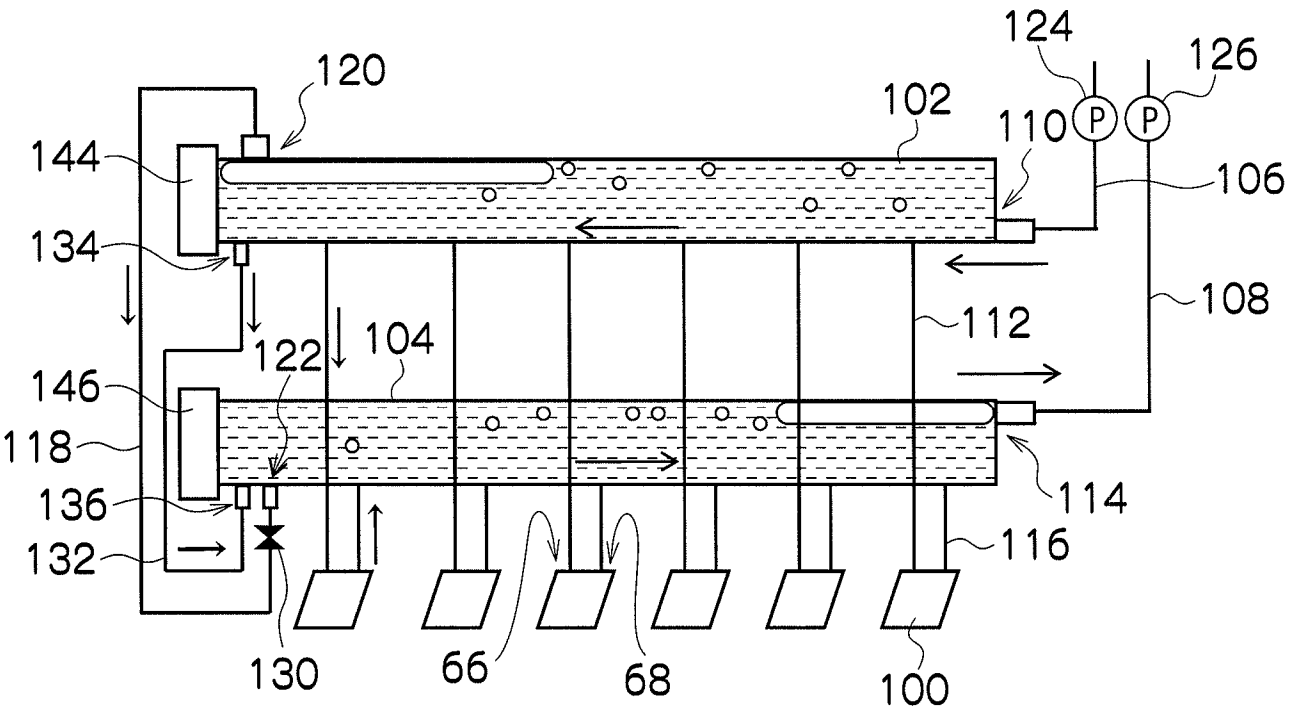
FIG. 10 is a schematic drawing showing the composition of an ink supply system according to a fifth embodiment.

FIG. 10 is a schematic drawing showing the composition of the ink supply system according to a fifth embodiment of the present invention. In FIG. 10, elements which are the same as or similar to those in FIGS. 6 to 9 are denoted with the same reference numerals and description thereof is omitted here.

In the fifth embodiment, a first pressure sensor 144 is disposed in the ink supply manifold 102 on the second end in the lengthwise direction thereof (the end on the opposite side from the ink inlet port 110), and a second pressure sensor 146 is disposed in the ink collection manifold 104 on the second end in the lengthwise direction thereof (the end on the opposite side from the ink outlet port 114) as shown in FIG. 10.

The pressure sensors 144 and 146 are pressure determination devices which respectively measure the internal pressures of the corresponding manifolds 102 and 104, and the measurement values (pressure values) determined by the pressure sensors 144 and 146 are reported to the system controller 72 shown in FIG. 5.

The system controller 72 controls the driving of the first liquid pump 124 and the second liquid pump 126 in such a manner that the internal pressures of the manifolds 102 and 104 assume target pressures, on the basis of the measurement values reported from the pressure sensors 144 and 146. The control method performed by the system controller 72 is similar to the first embodiment and description thereof is omitted here.

According to the fifth embodiment, it is possible to obtain measurement values which are little affected by dynamic pressure, by measuring the pressures in the portions of the slowest flow rate in the ink supply manifold 102 and the ink collection manifold 104 (the end portions of the manifolds most distant from the ink inlet port 110 and the ink outlet port 114, respectively). Hence, it is possible to control the internal pressures of the ink supply manifold 102 and the ink collection manifold 104 with greater accuracy, and further stabilization of the circulation of ink can be achieved.

Sixth Embodiment

Figure 11:
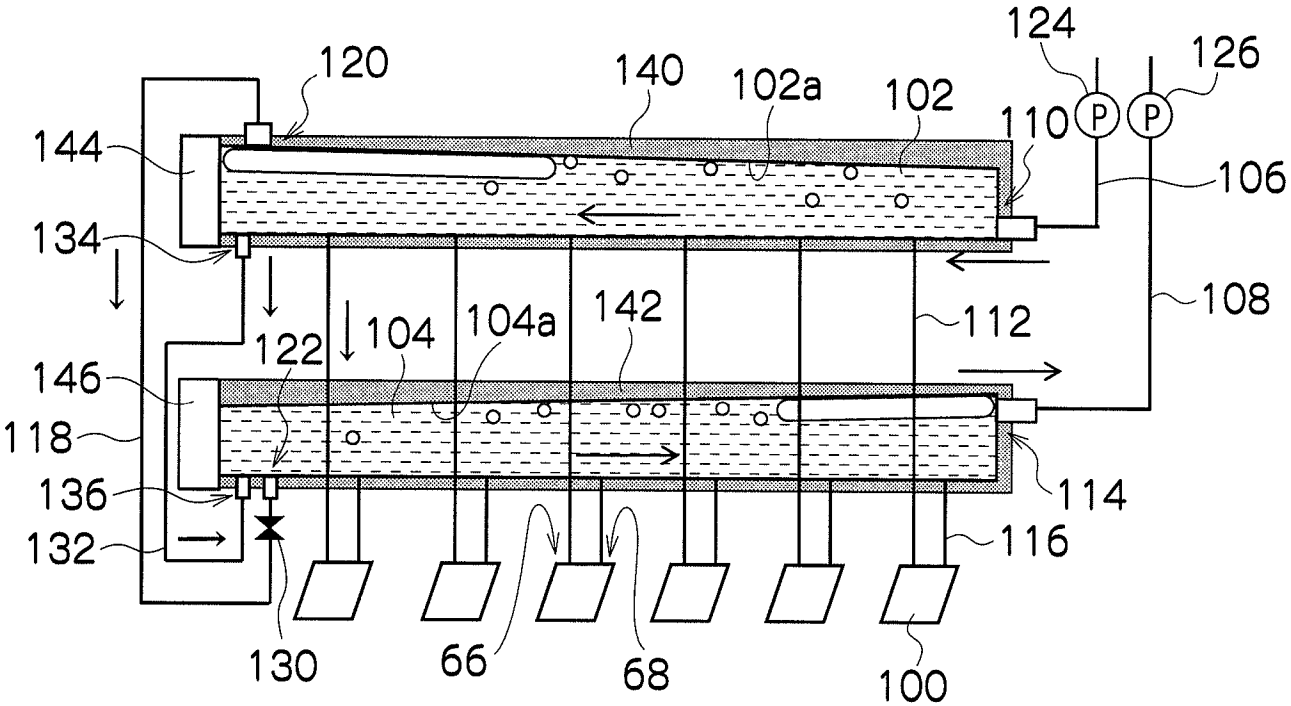
FIG. 11 is a schematic drawing showing the composition of an ink supply system according to a sixth embodiment.

FIG. 11 is a schematic drawing showing the composition of the ink supply system according to a sixth embodiment of the present invention. In FIG. 11, elements which are the same as or similar to those in FIGS. 6 to 10 are denoted with the same reference numerals and description thereof is omitted here.

In the sixth embodiment, the ceiling faces of the ink supply manifold 102 and the ink collection manifold 104 (the inner wall faces on the upper sides in FIG. 11) are inclined.

The ceiling face 102*a* of the ink supply manifold 102 is inclined in such a manner that the ceiling face 102*a* at the second end (the end on the side of the connection port 120) in the lengthwise direction of the ink supply manifold 102 is higher in the vertical direction than the ceiling face 102*a* at the first end of the ink supply manifold 102 (the end on the side of the ink inlet port 110). Hence, the bubbles which have entered into the ink supply manifold 102 are liable to collect in the periphery of the connection port 120 by following the inclination of the ceiling face 102*a*, in such a manner that the bubbles can be conveyed readily through the bubble expulsion bypass flow channel 118 to the ink collection manifold 104.

The ceiling face 104*a* of the ink collection manifold 104 is inclined in such a manner that the ceiling face 104*a* at the first end (the end on the side of the ink outlet port 114) in the lengthwise direction of the ink supply manifold 104 is higher in the vertical direction than the ceiling face 104*a* at the second end of the ink collection manifold 104 (the end on the side of the connection port 122). Hence, the bubbles collected in the ink collection manifold 104 are liable to collect in the periphery of the ink outlet port 114 by following the inclination of the ceiling face 104*a*, in such a manner that the bubbles can be conveyed readily through the second main flow channel 108 to the ink tank and released into the atmosphere in the ink tank.

According to the sixth embodiment, it is possible to improve the bubble expulsion characteristics inside the manifolds.

In the sixth embodiment, the composition is described in which the ceiling face 102*a* of the ink supply manifold 102 and the ceiling face 104*a* of the ink collection manifold 104 are constituted of inclined faces (i.e., the ceiling faces are oblique to the bottom faces); however, the present invention is not limited to this, and it is also possible to incline the whole of each manifold in a composition where the ceiling face is parallel to the bottom face, as in the ink supply manifold 102 and the ink collection manifold 104 of the first to fifth embodiments. In this case also, it is possible to improve the bubble expulsion characteristics inside the manifolds.

EXAMPLES

Specific examples of the respective units of the ink supply system according to the first embodiment (shown in FIG. 6) are described below.

It is possible to use an ink supply manifold 102 and an ink collection manifold 104 which have mutually similar shapes. The manifold flow channel length L is 750 mm, the cross-sectional shape of the manifold flow channel is circular, and the diameter of the manifold flow channel is 14 mm (if this diameter is not sufficient, then vertical separation of the air and the liquid does not occur). Polypropylene can be used as the material of the manifolds.

The pressure differential set between the ink supply manifold 102 and the ink collection manifold 104 is 4000 Pa.

The ink circulation flow volume is 9 ml/sec flow speed at the ink inlet port 110 and 7 ml/sec flow speed at the ink outlet port 114.

The ink used has a viscosity of 6 mPa·s, a surface tension of 36 mN/m, and temperature of 25° C.

The number of head modules 100 connected to the ink supply manifold 102 and the ink collection manifold 104 is seventeen (17), and the arrangement spacing M of the head modules 100 is 43 mm.

The bubble expulsion bypass flow channel 118 has an internal diameter of 4 mm and a length of 300 mm. The circulation bypass flow channel 132 used in the third to the sixth embodiments (shown in FIGS. 8 to 11) has an internal diameter of 2.5 mm and a length of 150 mm.

Each of the first main flow channel 106 and the second main flow channel 108 has an internal diameter of 6 mm.

Each of the first branch flow channels 112 and the second branch flow channels 116 has an internal diameter of 4 mm.

The bypass flow channels 118 and 132, and the branch flow channels 112 and 116 used have the diameters which do not produce vertical separation of the air and the liquid.

There follows a description of evaluation results to confirm the state of vertical separation of gas and liquid in cylindrical internal flow channels, and the state of entering of bubbles into the branch flow channels, when using the ink under the aforementioned conditions.

Figure 12:
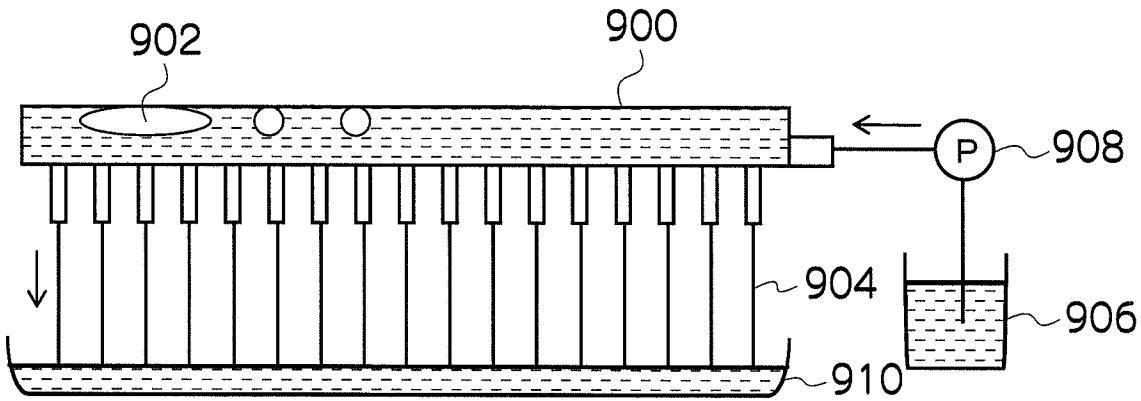
FIG. 12 is a schematic drawing showing the composition of an ink supply system used in evaluation experiments.

FIG. 12 is a diagram showing the composition of the evaluation experiments. In FIG. 12, the cylindrical internal flow channel was formed inside a pipe 900 made of polypropylene. The ink was sent from an ink tank 906 by a tube pump 908 to the pipe 900, in which bubbles 902 were mixed with the ink. The ink then flowed through branch flow channel pipes 904 and was received by an ink receptacle 910.

In the evaluation experiments, the following two items were evaluated using the experimental composition shown in FIG. 12.

<State of Air/Liquid Vertical Separation>

Bubbles were intentionally mixed with the ink filling the pipe 900, and the separated state was visually observed.

<Entering of Bubble into Branch Flow Channel>

Manifolds for evaluation were formed, in which seventeen (17) branch flow channel pipes 904 having an internal diameter of 4 mm were welded at a pitch of 43 mm to pipes 900 having respective internal diameters of 2.5 mm, 4.0 mm, 6.0 mm, 8.0 mm, 10.0 mm and 14.0 mm, each pipe 900 was filled with a mixture of bubbles and ink, and in this state, the tube pump 908 was driven to cause the ink to flow from the ink tank 906 into the pipe 900 at a flow rate of 9 ml/sec, and the state of entering of bubbles into the branch flow channel pipes 904 was visually observed.

Table 1 shows the evaluation results of the experiments.

TABLE 1

| | Internal diameter of flow channel (mm) | | | | | |
|---|---|---|---|---|---|---|
| | 2.5 | 4.0 | 6.0 | 8.0 | 10.0 | 14.0 |
| State of air/liquid vertical separation | Poor (no separation) | Poor (no separation) | Fair (partial separation) | Fair (partial separation) | Good (full separation) | Good (full separation) |
| Entering of bubble into branch flow channel | No assessment | Poor (bubbles entered) | Poor (bubbles entered) | Poor (bubbles entered) | Good (no bubbles entered) | Good (no bubbles entered) |

As shown in Table 1, if the internal diameter of the flow channel of the pipe 900 was 10 mm or greater, then the air and the liquid were completely separated in the vertical direction inside the pipe 900, and desirable results could be achieved in that no bubbles entered into the branch flow channel pipes 904.

The diameter of the manifolds 102 and 104 described above is 14 mm, and it can be seen from these evaluation experiments that this is a desirable dimension.

The inkjet recording apparatus according to the present invention has been described in detail above, but the present invention is not limited to the aforementioned examples, and it is of course possible for improvements or modifications of various kinds to be implemented, within a range which does not deviate from the essence of the present invention.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus, comprising:

a plurality of recording head modules each having supply ports and discharge ports for liquid;

a liquid supply manifold which is a liquid chamber having a liquid inlet port to which a first main flow channel is connected, the liquid supplied from a liquid tank through the first main flow channel being stored in the liquid supply manifold, the liquid supply manifold being connected to the supply ports of the recording head modules through first branch flow channels;

a liquid collection manifold which is a liquid chamber having a liquid outlet port to which a second main flow channel is connected, the liquid to be collected to the liquid tank through the second main flow channel being stored in the liquid collection manifold, the liquid collection manifold being connected to the discharge ports of the recording head modules through second branch flow channels;

a first bypass flow channel which connects the liquid supply manifold to the liquid collection manifold; and a liquid circulation device which circulates the liquid sequentially to the liquid supply manifold, the recording head modules and the liquid collection manifold, wherein:

the liquid supply manifold and the liquid collection manifold each have heights in a vertical direction which enable a gas getting mixed with the liquid to separate from the liquid in the vertical direction;

an end of the first bypass flow channel is connected to an upper side in the vertical direction of an end of the liquid supply manifold on a side opposite to a side where the liquid inlet port is arranged; and a second bypass flow channel which connects the liquid supply manifold to the liquid collection manifold, wherein an end of the second bypass flow channel is connected to the lower side in the vertical direction of the end of the liquid supply manifold on the side opposite to the side where the liquid inlet port is arranged, and the other end of the second bypass flow channel is connected to the lower side in the vertical direction of the end of the liquid collection manifold on the side opposite to the side where the liquid outlet port is arranged.

2. The inkjet recording apparatus as defined in claim 1, wherein the other end of the first bypass flow channel is connected to a lower side in the vertical direction of an end of the liquid collection manifold on a side opposite to a side where the liquid outlet port is arranged.

3. The inkjet recording apparatus as defined in claim 1, wherein the liquid inlet port is arranged to a lower side in the vertical direction of the liquid supply manifold.

4. The inkjet recording apparatus as defined in claim 1, wherein the liquid outlet port is arranged to an upper side in the vertical direction of the liquid collection manifold.

5. The inkjet recording apparatus as defined in claim 1, further comprising:

an opening and closing valve which is arranged in the first bypass flow channel; and a valve control device which controls opening and closing operations of the opening and closing valve, wherein the valve control device connects the liquid supply manifold to the liquid collection manifold through the first bypass flow channel by opening the opening and closing valve when performing expulsion of bubbles.

6. The inkjet recording apparatus as defined in claim 1, wherein a heat insulating member is arranged on an outer circumferential surface of the liquid supply manifold.

7. The inkjet recording apparatus as defined in claim 6, wherein a heat insulating member is arranged on an outer circumferential surface of the liquid collection manifold.

8. The inkjet recording apparatus as defined in claim 1, further comprising:

a first pressure determination device which determines an internal pressure of the liquid supply manifold; and a second pressure determination device which determines an internal pressure of the liquid collection manifold, wherein the liquid circulation device serves as a pressure adjustment device which adjusts the internal pressures of the liquid supply manifold and the liquid collection manifold to prescribed pressures in accordance with determination results obtained by the first and second pressure determination devices.

9. The inkjet recording apparatus as defined in claim 8, wherein:

the first pressure determination device is disposed in the end of the liquid supply manifold on the side opposite to the side where the liquid inlet port is arranged; and the second pressure determination device is disposed in the end of the liquid collection manifold on the side opposite to the side where the liquid outlet port is arranged.

* * * * *